US006863001B2

(12) United States Patent
Inage

(10) Patent No.: US 6,863,001 B2
(45) Date of Patent: Mar. 8, 2005

(54) SIDE SLIDING DOOR APPARATUS FOR ELECTRIC RAILCAR

(75) Inventor: Akio Inage, Mie (JP)

(73) Assignee: Fuji Electric Co., Ltd., Kawasaki (JP)

( * ) Notice: Subject to any disclaimer, the term of this patent is extended or adjusted under 35 U.S.C. 154(b) by 35 days.

(21) Appl. No.: 10/310,175

(22) Filed: Dec. 5, 2002

(65) Prior Publication Data

US 2003/0106458 A1 Jun. 12, 2003

(30) Foreign Application Priority Data

Dec. 12, 2001 (JP) ..... 2001-378051
Oct. 23, 2002 (JP) ..... 2002-308134

(51) Int. Cl.[7] ..... E05B 65/10
(52) U.S. Cl. ..... 105/341; 49/116
(58) Field of Search ..... 49/293, 300, 322, 49/116, 280, 295; 105/332, 339, 340, 341, 348, 349

(56) References Cited

U.S. PATENT DOCUMENTS 1,976,223 A 10/1934 Hedley et al.
4,290,368 A * 9/1981 Mazzini ..... 105/341
4,882,876 A * 11/1989 Daugirdas ..... 49/141
5,755,060 A * 5/1998 Zweili ..... 49/449
5,927,015 A 7/1999 Ghosn et al.
6,125,768 A 10/2000 Kurnik
6,139,073 A 10/2000 Heffner et al.
6,446,389 B1 9/2002 Heffner et al.

FOREIGN PATENT DOCUMENTS

DE 197 45 753 10/1997
GB 2328712 A * 3/1999 ..... E05C/17/50
JP 2000-142392 5/2000

* cited by examiner

*Primary Examiner*—Frantz F. Jules

(57) ABSTRACT

A sliding door apparatus has a sliding door movably supported on a horizontal door rail for opening and closing an entrance of a vehicle, i.e. railroad car. The sliding door is locked when a latch member engages a fixing member disposed on the sliding door. When an emergency handle is operated, the latch member is released from the fixing member, and the sliding door can be opened manually. A motion of the emergency handle is directly transmitted to the latch member to release the latch member from the fixing member. Therefore, it is possible to operate the sliding door reliably without a problem associated with the flexible wire.

8 Claims, 6 Drawing Sheets

SIDE SLIDING DOOR APPARATUS FOR ELECTRIC RAILCAR

BACKGROUND OF THE INVENTION AND RELATED ART STATEMENT

The present invention relates to a side sliding door apparatus having sliding doors for opening and closing an entrance at a side of an electric railcar.

For protecting passengers in an electric railcar, a side sliding door apparatus is required to have such a high reliability without any accidental operation while the railcar is running or staying stationary. In case of emergency, however, the side sliding door apparatus is required to be opened quickly by a simple operation. To this end, the inventors of the present application have developed a side sliding door apparatus for an electric railcar disclosed in Japanese Patent Publication (TOKKAI) No. 2000-142392.

FIG. 10 to FIG. 13 show the side sliding door apparatus for the electric railcar disclosed in the patent publication, and a brief description thereof will be given. FIG. 10 is a side view showing an entire structure of the side sliding door apparatus for the electric railcar, and FIG. 11 is an enlarged view showing essential parts thereof. In FIGS. 10 and 11, two sliding doors 1 and 2 are movably suspended from a door rail 3, which is mounted horizontally along a side of the electric railcar, via moving bodies 4. The sliding doors 1 and 2 are capable of moving horizontally in reverse directions to open and close an entrance of the electric railcar. The sliding door 1 at the left side in FIG. 10 is driven by a linear motor 5 as an actuator connected to the moving body 4 of the sliding door 1.

As shown in FIG. 11, a movable element 5*a* of the linear motor 5 is connected to the moving body 4 such that the movable element 5*a* can slide by a predetermined distance x in opening and closing directions (in the horizontal direction in FIG. 11). A compression spring 6 is interposed between the movable element 5*a* and the moving body 4. With this arrangement, the movable element 5*a* can freely move relative to the sliding door 1 by the predetermined distance x in the opening direction of the sliding door 1.

On the other hand, the sliding door 2 at the right side is moved along with a motion of the sliding door 1 via a direction changing mechanism 7. As shown in FIG. 11, the direction changing mechanism 7 is comprised of a lower rack 9 connected to the moving body 4 of the sliding door 1 via a connecting rod 8, an upper rack 11 connected to the moving body 4 of the sliding door 2 via a connecting plate 10, and a pinion 12 engaging the racks 9 and 11 at the same time. The lower rack 9 and the upper rack 11 are guided in a unit case 7*a* fixed on the railcar side such that they can slide in the opening and closing directions. A shaft fixed on the unit case 7*a* supports the pinion 12. The direction changing mechanism 7 changes a moving direction of the sliding door 1 driven by the linear motor 6 and transmits the motion to the sliding door 2.

FIGS. 12 and 13 show details of a locking mechanism 13 arranged at a side of the direction changing mechanism 7 in FIG. 10, as well as a push rod 14 and a pull fitting 15 for causing the locking mechanism 13 to lock and unlock. FIG. 12 shows a state in which the locking mechanism 13 locks the sliding doors 1, 2. FIG. 13 shows a state in which the locking mechanism 13 unlocks the sliding doors 1, 2. In FIGS. 12 and 13, the push rod 14 and the pull fitting 15 are mounted on the movable element 5*a* of the linear motor 5. The push rod 14 is fixed horizontally, and the pull fitting 15 with a hook end is placed over an upper surface of the push rod 14 and is connected to the push rod 14 to rotate vertically by a pin at one end. The pull fitting 15 is forced upward by a compression spring 16 interposed between the pull fitting 15 and the push rod 14, and is restricted in an upward rotational range by a headed pin 17 that loosely penetrates the push rod 14 to be screwed into the pull fitting 15. A guide fitting 18, which is arranged to contact an upper surface of the pull fitting 15 to limit the pull fitting 15 from rotating upward, is fixed at a front end of a frame of the linear motor 5.

The locking mechanism 13 is comprised of a vertical latch rod 22 guided in a guide cylinder 21 supported and fixed by the unit case 7*a* to slide in an axial direction, a latch plate 23 integrated with a head of the latch rod 22, and a lock spring 24 comprised of a tension spring for urging the latch rod 22 downward. For moving the locking mechanism 13 with the sliding door 1, the locking mechanism 13 is comprised of a slider 19 guided to slide in the moving direction of the sliding doors 1, 2, and a back spring 20 comprised of a compression spring for urging the slider 19 toward the sliding door 2. A cam surface 19*a* comprised of an inclined step is formed at an upper side of the slider 19. An engagement protrusion 19*b* is provided at an end of the slider 19. A roller 25 contacting the cam surface 19*a* of the slider 19 is rotatably mounted on the latch rod 22 via an attachment fitting (not shown). The lock spring 24 is extended between the latch plate 23 and the unit case 7*a* for urging the latch rod 22 downward. As described later, the latch rod 22 moves up and down in response to the opening and closing motions of the sliding doors 1, 2.

FIG. 12 shows a state in which the sliding doors 1, 2 are locked in a closed state in the above described side sliding door apparatus. In this state, an end of the latch rod 22 is inserted into the latch hole 26 of the upper rack 11 constituting an engagement section of the direction changing mechanism 7 to lock the sliding motion of the upper rack 11. Thus, the sliding doors 1, 2 connected to the upper rack 11 can not move. Further, in this state, the push rod 14 abuts against the engagement protrusion 19*b* of the slider 19, and the hook portion of the pull fitting 15 is engaged with the head of the engagement protrusion 19*b* with an inclined surface.

When an opening instruction is given in this state, the movable element 5*a* of the linear motor 5 moves leftward. At an initial stage of this movement, the movable element 5*a* moves leftward by a predetermined distance x with pressing the compression spring 6 while leaving the sliding door 1 in a closed position. In the meantime, the pull fitting 15 pulls the slider 19 via the engagement protrusion 19*b*. At this moment, the pull fitting 15 tries to rotate upward due to the urging force of the compression spring 16 and the action of the inclined surface of the head of the engagement protrusion 19*b*, but can not rotate because the guide fitting 18 presses the pull fitting 15.

When the slider 19 is pulled leftward, the roller 25 is pushed up onto the upper surface of the slider 19 via the inclined plane of the cam surface 19*a*, as shown in FIG. 13. This causes the latch rod 22 to be lifted and pulled out of the latch hole 26 to release from the upper rack 11, thereby unlocking the sliding doors 1, 2. When the movable element 5*a* moves for almost the predetermined distance x, the pull fitting 15 is released from the guide fitting 18. As a result, the pull fitting 15 is rotated upward by the urging force of the compressing spring 16 and is released from the engagement protrusion 19*b* of the slider 19. Even when the pull fitting 15 is released, the slider 19 remains in an advancement position due to the urging force of the back spring 20 and keeps the roller 25 pushed up.

Then, the movable element 5*a* moves the sliding door 1 leftward up to a predetermined full-open position. Accordingly, the sliding door 2 moving along with the sliding door 1 via the direction changing mechanism 7 moves rightward, so that the sliding doors 1, 2 are opened. The sliding door 1 then moves rightward in response to a closing instruction, and when the sliding door 1 reaches the closing position in FIG. 12, the movable element 5*a* pushes the slider 19 via the push rod 14. Consequently, the roller 25 falls off the upper side of the cam surface 19*a*, and the latch rod 22 enters the latch hole 26 of the upper lack 11 to lock the sliding doors 1, 2. At the same time, the guide fitting 18 pushes the pull fitting 15 to engage the engagement protrusion 19*b*.

In case of emergency, an emergency handle 28 in FIGS. 10 and 12 is turned 90° from a position indicated by a hidden line to a position indicated by a solid line in FIG. 12. The emergency handle 28 is connected to the latch plate 23 via a flexible cable wire 29. When the emergency handle 28 is rotated, the latch plate 23 is raised to pull the latch rod 22 out of the latch hole 26. As a result, the latch rod 22 is released from the upper rack 11, thereby enabling the sliding doors 1, 2 to be opened manually.

The above described side sliding door apparatus for the electric railcar disclosed in the patent publication turned out to have problems as described below.

The emergency handle is connected to the unlocking mechanism via the cable wire. When the emergency handle is operated, the cable wire pulls the latch rod to unlock the sliding doors. The cable wire, however, tends to have a play due to tension or loosening, and therefore it is difficult to securely unlock the sliding doors.

When the emergency handle is operated in the conventional apparatus, the sliding doors are unlocked, however remain closed. Thus, it is difficult to recognize that the sliding doors can be opened manually, thereby delaying for the passengers to quickly go out of the electric railcar.

It is therefore an object of the present invention to improve the reliability in the operation of emergency opening means in a side sliding door apparatus for an electric railcar, thus making emergency escape easier.

Further objects and advantages of the invention will be apparent from the following disclosure of the invention.

SUMMARY OF THE INVENTION

To attain the above object, the present invention provides a side sliding door apparatus having sliding doors movably supported by a horizontal door rail. The sliding doors are locked when a latch member movably guided and supported on a railcar side engages a fixing member disposed on a sliding door side. Upon release of the latch member from the fixing member by an operation of an emergency handle, the sliding doors can be opened manually. A motion of the emergency handle is directly transmitted to the latch member to release the latch member from the fixing member. More specifically, according to the present invention, the motion of the emergency handle is rigidly transmitted to the latch member without going through a flexible cable wire or a movable link. Therefore, it is possible to reliably operate the sliding doors without a problem due to tensioning or loosening of a cable wire.

It is preferred that when the emergency handle is operated, at the same time, a part of the emergency handle pushes the fixing member disposed on the sliding door to form a space between the sliding doors. With this arrangement, the space is formed between the sliding doors when the emergency handle is operated. Thus, it is possible to visually recognize that the sliding doors can be opened, and to easily open the sliding doors manually by putting a hand in the space.

Further, it is preferred that the emergency handle is arranged to recede easily when the fixing member on the sliding door side abuts against the emergency handle when the sliding doors are closed after the emergency handle is operated to manually open the sliding doors. With this arrangement, after being unlocked manually, when the sliding door is closed manually and abuts against the emergency handle, the emergency handle will not be damaged because the emergency handle recedes to absorb the impact. In this case, if the emergency handle returns to an original position before the operation, the sliding doors are locked again. Therefore, it is preferred to provide a braking mechanism to stop the emergency handle in front of the original position where the sliding doors are locked again when the emergency handle is receded due to the collision of the fixing member on the sliding door side. This prevents the sliding doors from being locked again.

The braking mechanism may be comprised of a ball movably fitted in the emergency handle to receive a back-pressure of a compression spring, and a guide member provided on a railcar side to follow a track of the ball when the emergency handle is operated. The guide member forms a guide surface on which the ball slides. When the ball approaches a step portion formed on the guide surface, the emergency handle receded due to the collision is stopped.

It is preferred that the emergency handle presses the fixing member on the sliding door side with which the latch member is engaged. Also, the latch member may be comprised of a latch rod capable of sliding in an axial direction. The latch rod is inserted into a latch hole formed in the fixing member on the sliding door side to be engaged with the fixing member.

The emergency handle may be comprised of a rotary handle having a cam section at one end and a handle at the other end. The cam section presses an arm integrated with the latch rod to pull the latch rod out from the latch hole.

It is preferred that the emergency handle presses the fixing member on the sliding door side by the handle.

It is possible to provide means for detecting an operation of the emergency handle. The detecting means transmits an operation signal to shut off power supply to an actuator so that the sliding doors can open and close manually. Thus, it becomes easy and safe to manually open the unlocked sliding doors.

DETAILED DESCRIPTION OF PREFERRED EMBODIMENTS

Figure 1:
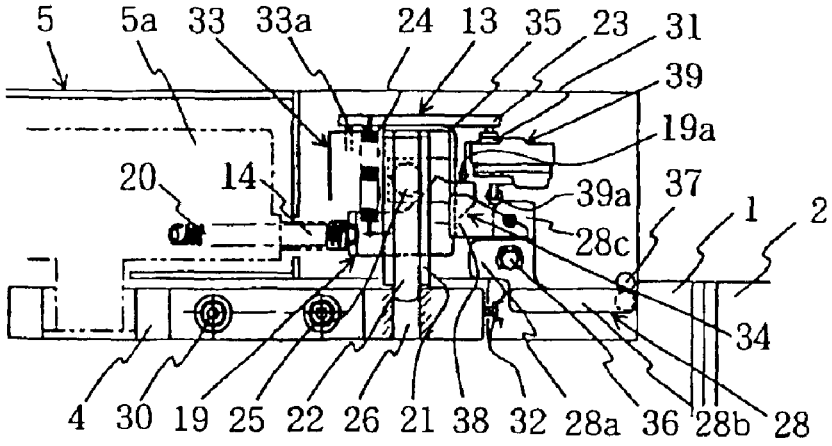
FIG. 1 is a side view showing a side sliding door apparatus in a locked state according to an embodiment of the present invention.

Hereunder, embodiments of the invention will be explained with reference to the accompanying drawings. FIGS. 1 to 4 show a sliding door apparatus for an electric rail car according to the first embodiment of the present invention. Elements and parts corresponding to those of the conventional door apparatus shown in FIGS. 10 to 13 are denoted by the same reference numerals.

FIG. 1 is a side view showing essential parts of the side sliding door apparatus in a locked state. In FIG. 1, as is the case with the prior art, two sliding doors 1, 2 are suspended via moving bodies 4 from a door rail (not shown) mounted horizontally along a side of an electric railcar. The two sliding doors move horizontally in reverse directions in FIG. 1 to open and close an entrance of the electric railcar.

A linear motor 5 as an actuator for opening and closing the sliding doors 1, 2, a locking mechanism for locking the closed sliding doors 1, 2, and an unlocking mechanism for unlocking the sliding doors 1, 2 are provided for respective ones of the two sliding doors 1, 2 (in FIG. 1, the linear motor 5 and other parts are shown only in the left sliding door 1). Therefore, even if the linear motor 5 for one of the two sliding doors 1, 2 breaks down, the linear motor 5 for the other one can open and close. A description of the sliding door 1 will be described next. Structures and operations of the sliding door 1 are identical with those of the sliding door 2.

In FIG. 1, the moving body 4 is fixed to the sliding door 1 by two bolts 30, and a movable element 5*a* of the linear motor 5 is connected to the moving body 4. In a state in which the sliding door 1 is closed as shown in FIG. 1, the sliding door 1 is locked by a locking mechanism 13. The locking mechanism 13 is comprised of a latch rod 22 as a latch member slidably supported in a vertical direction on the railcar side, and a lock spring 24 comprised of a tension coil spring as a forcing member for urging the latch rod 22 toward the sliding door 1. The latch rod 22 is comprised of a circular rod, and is guided into a hollow square guide cylinder 21 to move in and out a latch hole 26 formed in the moving body 4 as a fixing member of the sliding doors. A latch plate 23 is secured to a head of the latch rod 22, and the lock spring 24 extends between the latch plate 23 and the guide cylinder 23 with being pressed. The latch rod 22 inserted into the latch hole 26 is engaged with the moving body 4 to lock the sliding door 1 in a closed state.

A reference numeral 31 denotes a lock or limit switch as lock detecting means. The lock switch 31 fixed on the railcar side is turned on to transmit a locking signal to the railcar in the locked state as shown in FIG. 1. A reference numeral 32 denotes a door-closing switch as door closure detecting means. The closure detecting means 32 is turned on to transmit a door closure signal to the railcar in the closed state as shown in FIG. 1. An electromagnetic solenoid 33 is provided as an unlocking mechanism for driving the latch rod 22 against the force of the lock spring 24. The electromagnetic solenoid 33 is fixed vertically on the railcar, and when the electromagnetic solenoid 33 is off, a plunger 33*a* thereof located at the lower end of a stroke is positioned in the vicinity of a lower surface of the latch plate 23.

In FIG. 1, release holding means 34 is provided for holding the latch rod 22 in a state released from the moving body 4. The release holding means 34 is comprised of a slider 19 as locking means for locking the latch rod 22 in a position released from the moving body 4, and a back spring 20 having a tension coil spring as forcing means for forcing the slider 19 toward the latch rod 22. The slider 19 is supported on the railcar side to slide horizontally in FIG. 1, and contacts a roller 25 integrated with the latch rod 22 via a cam surface 19*a* to prevent the latch rod 22 from entering the latch hole 26. The roller 25 is rotatably mounted on a mounting plate 35 integrated with a head of the latch head 22. The back spring 20 has one end thereof hooked on the slider 19 and the other end thereof hooked on the railcar. Therefore, in the closed state shown in FIG. 1, the slider 19 is pushed rightward in FIG. 1 by a push rod 14 mounted at an end of the movable element 5*a*. Also, the cam surface 19*a* is released from the roller 25, and the back spring 20 is pressed.

A reference numeral 28 denotes an emergency handle, namely a manually operating rotary handle. The emergency handle 28 has a Z-shape with a cam section 28*a* at one end thereof and a handle 28*b* at the other end as shown in FIG. 1. The emergency handle 28 is rotatably supported on the railcar side. Normally, the emergency handle 28 is positioned horizontally with being restricted in a position by a stopper 37. A switch operating section 28*c* is integrated with the operating handle 28. In the state shown in FIG. 1, an unlock arm 38 is positioned in the vicinity of the cam section 28*a*, and the unlock arm 38 is bent to be integrated with the mounting plate 35. A reference numeral 39 denotes an emergency handle switch for detecting the operation of the emergency handle 28. In the state shown in FIG. 1, the actuator 39*a* is in ON state while pressed by the switch operating section 28*c*.

A normal opening and closing operation will be explained with reference to FIG. 1. In response to an opening instruction in the closed state shown in FIG. 1, the electromagnetic solenoid 33 is turned on and the plunger 33*a* is pulled to protrude upward. The plunger 33*a* lifts the latch rod 22 via the latch plate 23 to release the latch rod 22 from the latch hole 26. The latch rod 22 is released from the moving body 4 to unlock the sliding door 1. On this occasion, the lock switch 31 is actuated to transmit an unlocking signal to the railcar side. The unlock spring 24 is tensioned to generate a force for urging the latch rod 22 downward.

After a predetermined time since the unlocking signal is transmitted from the lock switch 31, the linear motor 5 is turned on, and the movable element 5*a* starts moving leftward in FIG. 1. On this occasion, the door closure switch 32 is turned off to transmit an opening signal to the railcar. Upon movement of the movable element 5*a*, the slider 19 pushed by the push rod 14 moves in the same direction as the movable element 5*a* by an urging force of the back spring 20 to cause the cam surface 19*a* to move below the roller 25.

In this state, the slider 19 abuts against a front surface of a housing for the linear motor 5 and then stops.

After a predetermined period of time since a closing signal is sent from the door closure switch 32, the electromagnetic solenoid 33 is turned off. This causes the latch rod 22 lifted by the plunger 33*a* to move downward due to an urging force of the lock spring 24, but stops when the roller 25 abuts against the cam surface 19*a*, so that the sliding doors 1, 2 remain unlocked.

In response to a closing instruction in the opened state, the movable element 5*a* moves rightward to bring the push rod 14 to contact with the slider 19. As the movable element 5*a* further moves from this point, the push rod 14 presses the slider 19 rightward to release the cam surface 19*a* from the roller 25. This causes the latch rod 22 to move downward by the urging force of the lock spring 24, so that the end thereof abuts against the moving body 4. With the rightward movement of the moving body 4, the latch rod 22 falls into the latch hold 26 to lock the sliding door 1 while sliding on the upper surface of the moving body 4. As a result, the side sliding door apparatus is brought again into the locked state shown in FIG. 1. In the meantime, the back spring 20 is stretched to restore the urging force for the next sliding door opening action.

Figure 2:
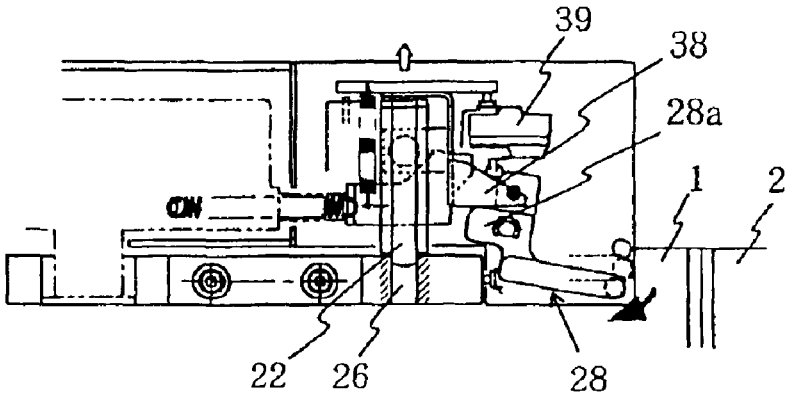
FIG. 2 is a side view showing an emergency unlocking action of the side sliding door apparatus in FIG. 1.

An emergency opening operation will be explained with reference to FIGS. 2 to 4. FIG. 2 shows an initial stage of an operation of the emergency handle 28. When the emergency handle 28 is slightly rotated clockwise in a direction indicated by an arrow, the cam part 28*a* pushes up the unlock arm 38, and accordingly, the latch rod 22 starts exiting the latch hole 26. On this occasion, an emergency handle switch 39 is turned off, and an emergency operation signal is transmitted to the railcar side. This shuts off the power to the linear motor 5.

Figure 3:
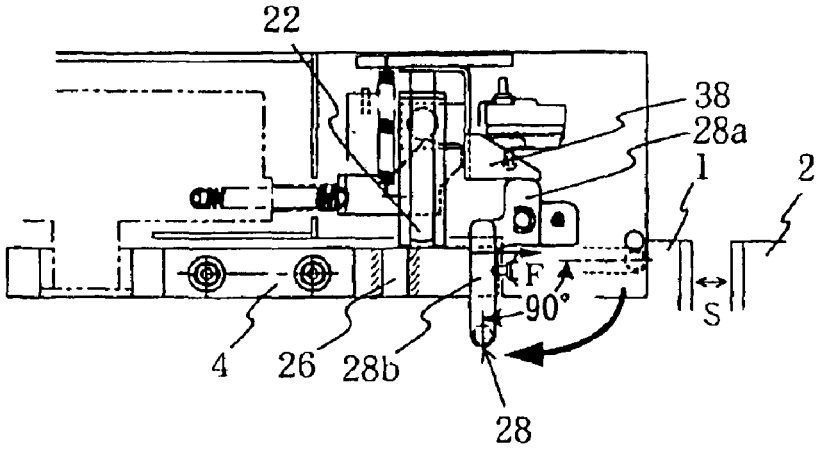
FIG. 3 is a side view showing an emergency unlocking action of the side sliding door apparatus in FIG. 1.

FIG. 3 shows a state in which the emergency handle 28 is turned upright 90° from the position in FIG. 2 in a direction indicated by an arrow. In this state, the latch rod 22 is completely pulled out from the latch hole 26, and the sliding door 1 is unlocked. In this case, the emergency handle 28 transmits its rotation directly to the unlock arm 38 integrated with the latch rod 22, thereby eliminating delayed or insufficient locking operation. In the process of the rotation, the emergency handle 28 slightly presses the moving body 4 as the fixing member on the sliding door side leftward via the handle 28*b*. This forms a space S between the sliding door 1 and the sliding door 2. Thus, it is possible to recognize that the sliding door 1 is unlocked, and the sliding door 1 can easily be opened manually by inserting a hand into the space S.

Figure 4:
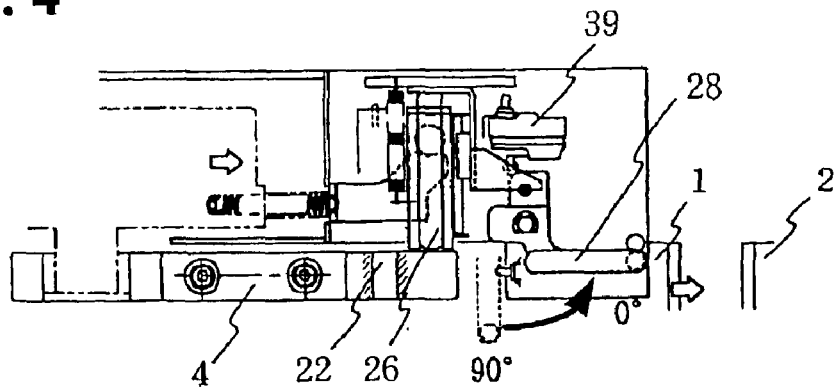
FIG. 4 is a side view showing a state in which an emergency handle in FIG. 3 returns to an original position.

FIG. 4 shows a state in which the emergency handle 28 is returned to the original position. When the emergency handle 28 is returned to the original position, the emergency handle switch 39 is pressed to supply the power to the linear motor 5 to close the sliding door 1, so that the sliding door 1 is locked automatically as mentioned above. Incidentally, although there are two sliding doors in the illustrated embodiment, the present invention should not be limited to this, and applicable to a side sliding door apparatus having only one sliding door.

FIGS. 5 to 9 show a side sliding door apparatus for an electric railcar according to the second embodiment of the present invention. In the first embodiment, the handle 28*b* of the emergency handle 28 is upright after rotated by 90° from the wait position as shown in FIG. 3, and the handle 28*b* is in contact with an end face of the moving body 4 in parallel. A flat end face of the cam part 28*a* contacts a lower surface of the unlock arm 38 in parallel. When the sliding door 1 is manually opened in this unlocked state, if the sliding door 1 is manually closed for some reason, the moving body 4 collides with the handle 28*b* of the emergency handle 28 from the left side in FIG. 3. This causes the emergency handle 28 to try to rotate counterclockwise and recede. However, the emergency handle 28 in FIG. 3 tends to receive a large impact as described below.

Specifically, in the unlocked state in FIG. 3, the flat end face of the cam part 28*a* of the emergency handle 28 contacts the lower surface of the unlock arm 38. Also, the center of the contact surface between the cam part 28*a* and the unlock arm 38 in the horizontal direction in FIG. 3 is located just above an axis 36 that is a pivot of the emergency handle 28. Therefore, in order to rotate the emergency handle 28 counterclockwise, the unlock arm 38 must be pushed up against the force of the lock spring 24, thereby creating a large resistance. The handle 28*b* contacts the end face of the moving body 4 in parallel as well. Therefore, when the moving body 4 collides with the handle 28*b*, an application point of an impact force F is not constant. Assuming that the impact force F is applied to the handle 28*b* at a top end face of the moving body 4 as shown in FIG. 3, an arm length of the rotational moment around the axis 36 is small, thereby making it difficult to rotate the emergency handle 28. For the reasons stated above, in the state shown in FIG. 3, when the sliding door 1 collides with the emergency handle 28, a large impact is applied to the handle 28*b* to damage the emergency handle 28. The second embodiment of the present invention is intended to solve this problem.

Figure 5:
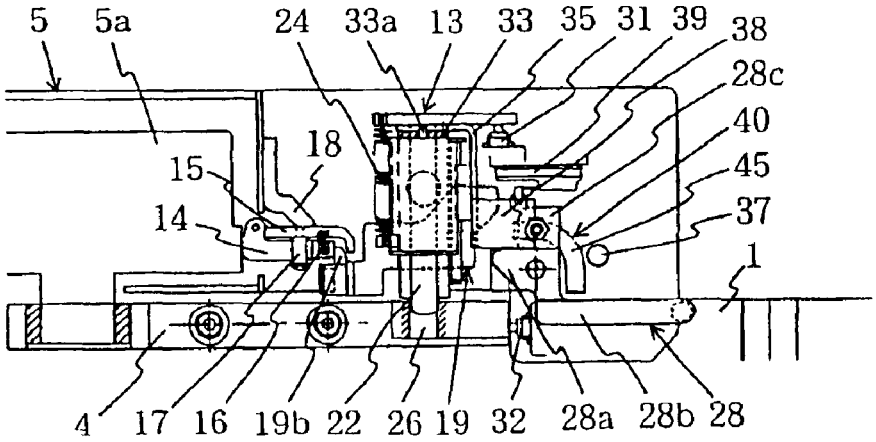
FIG. 5 is a side view showing a side sliding door apparatus in a locked state according to another embodiment of the present invention.

In FIG. 5, the cam part 28*a* of the emergency handle 28 has a pointed tip formed in a triangle shape. The end face of the cam part 29*a*, which contacts the unlock arm 38 in the unlocked state, is rounded in an arc shape. When the emergency handle 28 is slightly rotated clockwise in a direction indicated by an arrow in the locked state in FIG. 5, the cam part 28*a* starts pushing up the unlock arm 38. On this occasion, the emergency handle switch 39 is turned off, and an emergency operation signal is transmitted to the railcar side. This shuts off the power supply to the linear motor 5.

Figure 6:
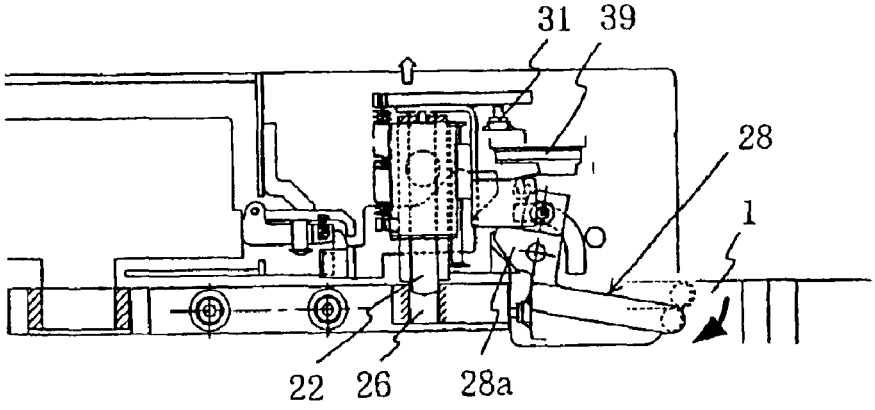
FIG. 6 is a side view showing an emergency unlocking action of the side sliding door apparatus in FIG. 5.
Figure 7:
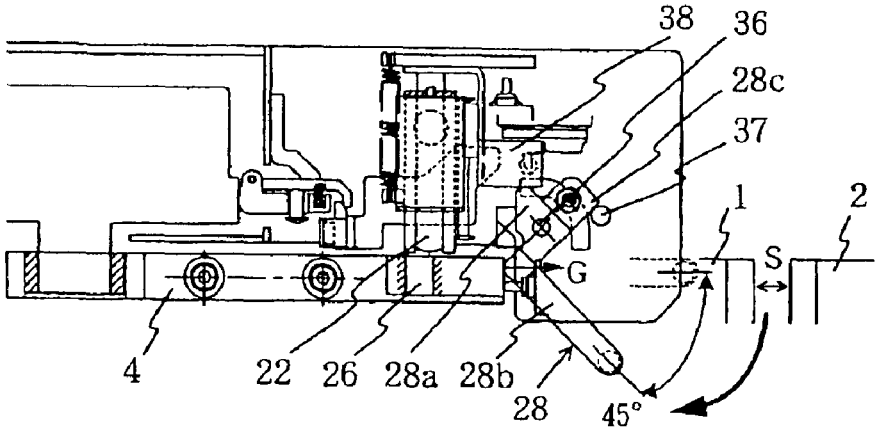
FIG. 7 is a side view showing an emergency unlocking action of the side sliding door apparatus in FIG. 5.

When the emergency handle 28 is further rotated in the direction indicated by the arrow from the operating position indicated in FIG. 6, the unlock arm 38 is further pushed up to cause the latch rod 22 to exit the latch hole 26 and unlock the sliding door 1. At the same time, the emergency handle 28 presses the moving body 4 leftward at a rounded corner of an L-shape connection where the cam part 28*a* and the handle 28*b* are connected to each other. FIG. 7 shows the unlocked state after the emergency handle is rotated from the wait position by 45°. The cam part 28*a* is brought into contact with the stopper 37 to restrict a position of the emergency handle. In this state, a space S is formed between the sliding door 1 and the sliding door 2, so that they can be opened manually.

Figure 8:
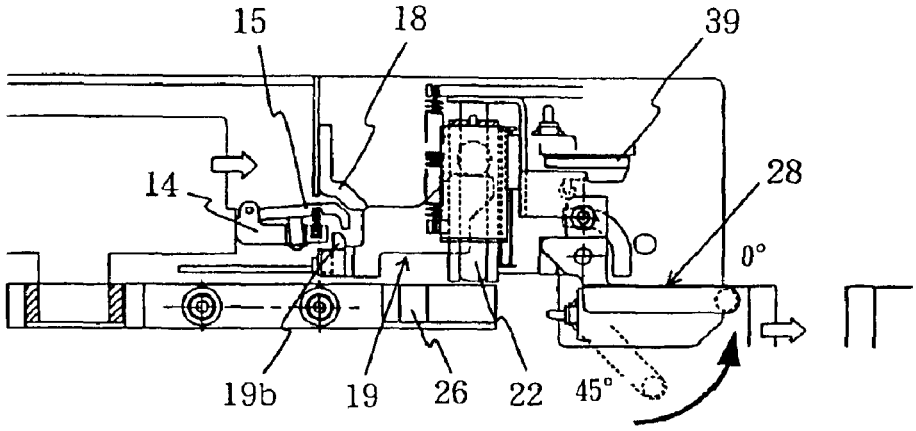
FIG. 8 is a side view showing a state in which an emergency handle in FIG. 7 returns to an original position.

FIG. 8 shows a state in which the emergency handle 28 is returned to the original position. When the emergency handle 28 is returned from the position at 45° to a position at 0°, the emergency handle switch 39 is turned on to supply the power to the linear motor 5, which moves the sliding door 1 in the closing direction to be automatically locked by the normal closing action.

In the second embodiment, in the unlocked state in FIG. 7, the arc surface of the end of the cam part 28*a* is in contact with the unlock arm 38, and the point of contact is deviated counterclockwise in FIG. 7 from a position just above the axis 36. If the manually opened sliding door 1 is closed manually again and a force G is applied to the emergency handle 28 due to collision with the moving body 4, the emergency handle 28 receded due to the collision moves in such a direction that the cam part 28*a* moves away from the unlock arm 38. Thus, the emergency handle 28 can easily rotate counterclockwise without being disturbed by a reactive force of the lock spring 24 acting on the emergency handle 28 via the cam part 28*a*. Further, since the force G of the moving body 4 is applied on the arc surface at the corner of the emergency handle 28, the arm length of the rotational moment around the axis 36 due to the collision force G is constant, so that the emergency handle 28 can rotate (recede) stably. As a result, in the second embodiment, when the sliding door 1 collides with the emergency handle 28, the collision force G is reduced as compared with the first embodiment (G<F). Therefore, the collision force G is more unlikely to damage the emergency handle 28.

If the emergency handle 28 returns to the position at 0° in a case where the emergency handle 28 recedes from the operating position at 45° due to the collision with the sliding door 1, the sliding door 1 is automatically locked as mentioned above, thereby making it impossible to be opened manually. To solve this problem, the side sliding door apparatus is provided with a braking mechanism 40 for stopping the emergency handle 28 receding due to the collision with the sliding door 1 in front of such a position that the sliding door 1 is locked again.

Figure 9:
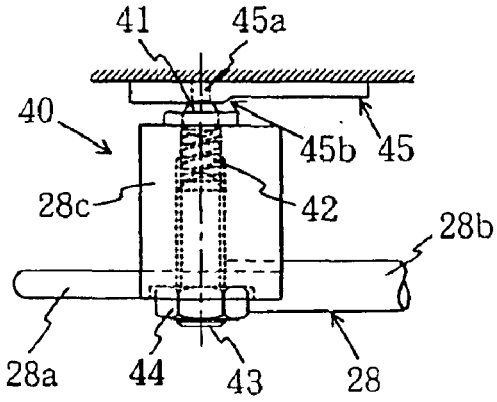
FIG. 9 is a plan view showing a braking mechanism in FIG. 5.
Figure 10:
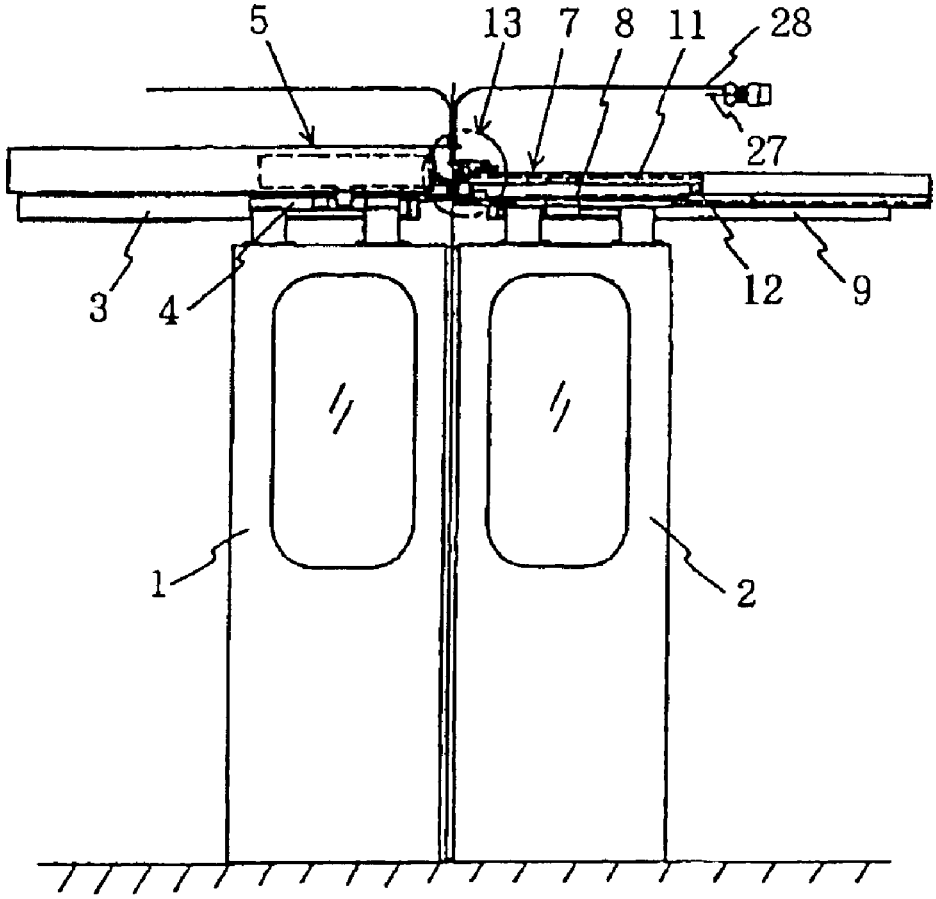
Fig. 10 Prior Art
FIG. 10 is a side view showing an entire structure of a conventional side sliding door apparatus.
Figure 11:
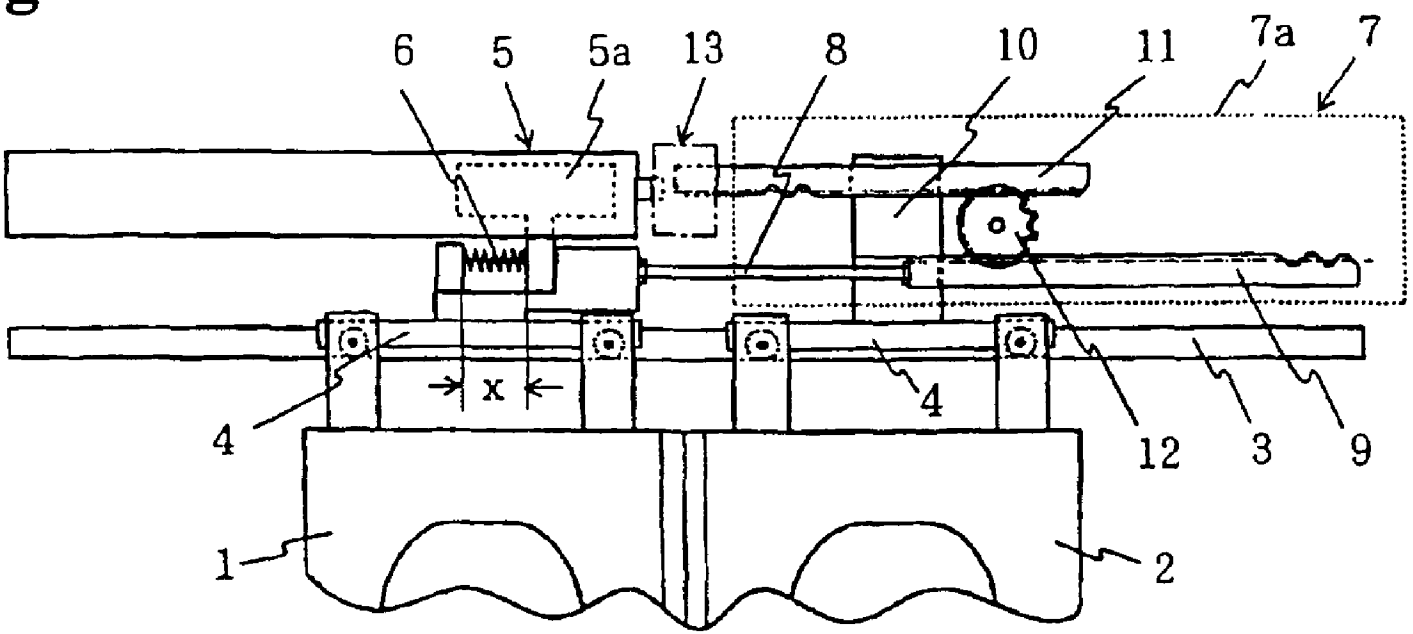
Fig. 11 Prior Art
FIG. 11 is an enlarged view showing essential parts of the side sliding door apparatus in FIG. 10.
Figure 12:
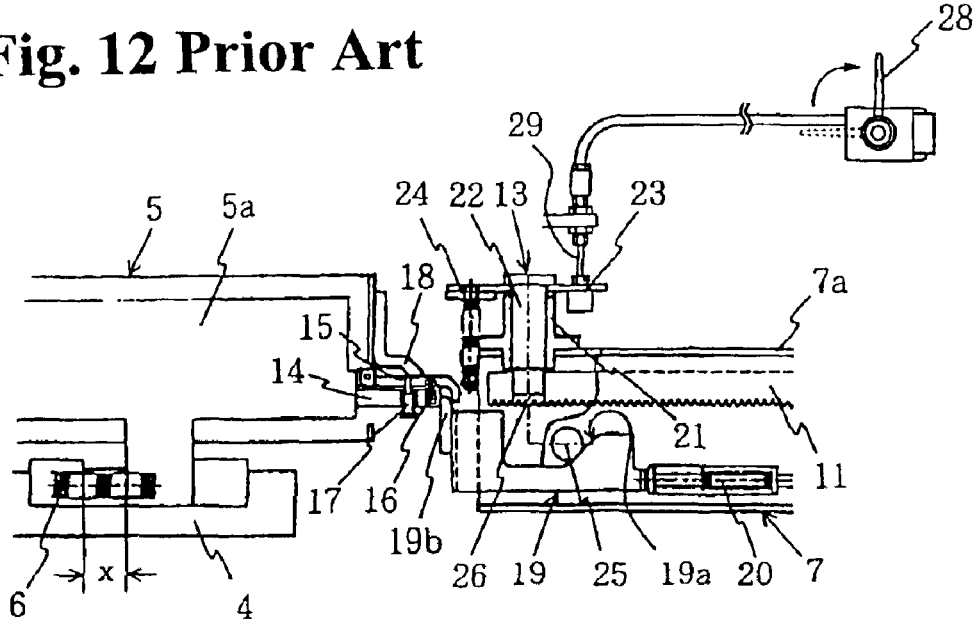
Fig. 12 Prior Art
FIG. 12 is a side view showing a locking action of the side sliding door apparatus in FIG. 10.
Figure 13:
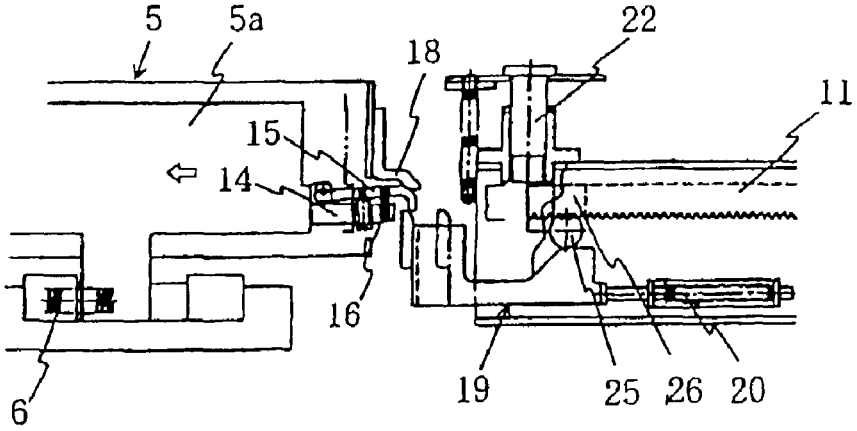
Fig. 13 Prior Art
FIG. 13 is a side view showing an unlocking action of the side sliding door apparatus in FIG. 12.

FIG. 9 is an enlarged plan view showing the braking mechanism, wherein the emergency handle 28 in FIG. 5 is viewed from above. In FIG. 9, the switch operating section 28*c* is formed like a square cylinder protruding toward the cam part 28*a*. A rounded hole is formed in the switch operating section 28*c* to penetrate through the switch operating section 28*c* in an axial direction such that the emergency handle 28 is positioned just above the axis 36 in the locked state in FIG. 5. A ball 41 is fitted in a back of the rounded hole in FIG. 5, i.e. in an upper end of the rounded hole in FIG. 9, such that the ball can enter and exit the round hole, and the ball 41 receives a back pressure from a compression spring 42. The compression spring 42 is pressed by an adjusting screw 43 comprised of an embedded bolt screwed into a female screw threaded in the rounded hole from the lower side in FIG. 9. The adjusting screw 43 is fixed by a lock nut 44.

The arc guide member 45 for forming a guide surface on which the ball 41 slides is fixed to the railcar side along a track of the ball 41 when the emergency handle 28 is rotated. An end of the ball 41 pressed to the guide member 45 by the compression spring 42 in the locked state in FIG. 5 falls into a hole 45*a* formed in the guide member 45, and the ball stays there. The adjusting screw 43 is moved in the axial direction to adjust a pressure of the ball 41 against the guide member 45. As shown in FIG. 9, a step 45*b* is formed on the guide surface of the guide member 45 on which the ball 41 contacts, and the guide member 45 has a greater thickness on a side where the hole 45*a* is formed than on the opposite side. The step 45*b* is located at a position where the ball 41 approaches just before the emergency handle 28 is returned counterclockwise from the operating position in FIG. 7 to cause the latch rod 22 to start entering into the latch hole 26. A higher side and a lower side of the guide member 45 are formed continuously at an inclined surface of the step 45*b*.

In the braking mechanism 40 described above, when the emergency handle 28 is operated in the locked state in FIG. 5, the ball 41 is released from the hole 45*a* of the guide member 45 to roll down on the step 45*b*. The ball 41 is positioned at the lower side of the guide surface in the unlocked state in FIG. 7. When the emergency handle 28 recedes counterclockwise in response to the collision with the sliding door 1, the ball 41 slides on the guide member 45 toward the step 45*b*. When the ball 41 approaches the step 45*b*, however, the emergency handle 28 is damped to stop the ball 41 in front of the higher side of the guide member 45. Therefore, the emergency handle 28 does not return to the locking position in FIG. 5. As a result, even when the manually opened sliding door 1 is closed manually, the sliding door 1 will not be automatically locked by the return of the emergency handle 28.

In the second embodiment shown in FIG. 5, a pull fitting 15, a compression spring 16, a headed pin 17, a guide fitting 18, and an engagement protrusion 19*b* of the slider 19 are provided in place of the back spring 20 of the first embodiment. These component parts are identical with those of the prior art described with reference to FIGS. 12 and 13, and a brief description thereof will be given.

In response to the opening instruction given to the sliding door 1 in the closed state in FIG. 5, the electromagnetic solenoid 33 unlocks the sliding door 1. The unlocking signal from the unlock switch 31 causes the movable element 5*a* of the linear motor 5 to start moving leftward as in the case of the above described first embodiment. On this occasion, in the state in FIG. 5, the pull fitting 15 pulls the slider 19 via the engagement protrusion 19*b* to a position below the roller 25. When the slider 19 reaches the position just below the roller 25, the pull fitting 15 is released from the guide fitting 18 and opens upward to be released from the engagement protrusion 19*b*.

In the closing action of the sliding door 1, the rightward movement of the movable element 5*a* causes the push rod 14 to push the slider 19 via the engagement protrusion 19*b*, so that the slider 19 is released form the roller 25. Further, when the pull fitting 15 approaches the guide fitting 18, the pull fitting 15 is depressed to engage the engagement protrusion 19*b* again. In the second embodiment, the back spring 20 does not need to be extended (FIG. 1) in the closing action. Therefore, the capacity of the linear motor 5 can be reduced.

As described above, according to the present invention, the motion of the emergency handle is directly transmitted to the latch member of the locking mechanism. Thus, it is possible to unlock the sliding doors manually and securely without any play. At the same time, the emergency handle presses the sliding doors to form the space therebetween. Thus, it can be recognized visually that the sliding doors are unlocked, thereby facilitating the passengers to quickly escape from the electric railcar.

While the invention has been explained with reference to the specific embodiments of the invention, the explanation is illustrative and the invention is limited only by the appended claims.

What is claimed is:

1. A sliding door apparatus for opening and closing an entrance of a vehicle, comprising:

a sliding door, a horizontal door rail disposed horizontally above the entrance of the vehicle for supporting the sliding door, an actuator connected to the sliding door for driving the same, a latch member movably supported on the vehicle, a fixing member disposed on the sliding door for engaging the latch member to lock the sliding door, and an emergency handle for releasing the latch member from the fixing member to unlock the sliding door, said emergency handle being disposed to directly associate with the latch member to release the latch member from the fixing member and having a portion to push the fixing member to thereby move the sliding door by a predetermined distance when the emergency handle is operated.

2. A sliding door apparatus according to claim 1, wherein the emergency handle is disposed to recede when the fixing member collides with the emergency handle in case the sliding door is manually closed after the emergency handle is operated to unlock the sliding door.

3. A sliding door apparatus according to claim 2, further comprising a braking mechanism for stopping the emergency handle before the sliding door is locked after the emergency handle recedes when the fixing member collides with the emergency handle.

4. A sliding door apparatus according to claim 3, wherein said braking mechanism comprises a ball movably fitted on the emergency handle, a spring for urging the ball in a direction away from the emergency handle, and a guide member provided on the vehicle for forming a path of the ball, said guide member having a guide surface on which the ball slides and a step portion formed on the guide surface for stopping the emergency handle receding by the collision with the fixing member.

5. A sliding door apparatus according to claim 1, wherein said latch member includes a latch rod capable of sliding in an axial direction, and said fixing member includes a latch hole for receiving the latch rod to engage the fixing member.

6. A sliding door apparatus according to claim 5, wherein said emergency handle includes a rotary handle having a cam section at one end and a handle at the other end, and the latch rod includes an arm integrated therewith so that the cam section of the emergency handle presses the arm to release the latch rod from the latch hole when the emergency handle is operated.

7. A sliding door apparatus according to claim 6, wherein said handle of the emergency handle is located adjacent to the fixing member to press the same when the emergency handle is operated.

8. A sliding door apparatus for opening and closing an entrance of a vehicle, comprising:

a sliding door, a horizontal door rail disposed horizontally above the entrance of the vehicle for supporting the sliding door, an actuator connected to the sliding door for driving the same, a latch member movably supported on the vehicle, a fixing member disposed on the sliding door for engaging the latch member to lock the sliding door, an emergency handle for releasing the latch member from the fixing member to unlock the sliding door, said emergency handle being disposed to directly associate with the latch member to release the latch member from the fixing member, and lock detecting means for detecting a movement of the emergency handle when the emergency handle is operated, said lock detecting means transmitting a signal for turning off the actuator.

* * * * *